US011124863B2

(12) United States Patent
Kayama et al.

(10) Patent No.: US 11,124,863 B2
(45) Date of Patent: Sep. 21, 2021

(54) COATING WEIGHT CONTROL APPARATUS AND COATING WEIGHT CONTROL METHOD

(71) Applicants: Hitachi, Ltd., Tokyo (JP); Nippon Steel Nisshin Co., Ltd., Tokyo (JP)

(72) Inventors: Masahiro Kayama, Tokyo (JP); Shigetoshi Kurihara, Tokyo (JP); Takanori Iwahiro, Tokyo (JP); Hisao Morishita, Tokyo (JP); Kazuhiko Soga, Tokyo (JP); Yuta Hirano, Tokyo (JP)

(73) Assignees: Hitachi, Ltd., Tokyo (JP); Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 16/686,612

(22) Filed: Nov. 18, 2019

(65) Prior Publication Data

US 2020/0208247 A1 Jul. 2, 2020

(30) Foreign Application Priority Data

Dec. 28, 2018 (JP) ..... JP2018-248025

(51) Int. Cl.
*C23C 2/20* (2006.01)
*C23C 2/40* (2006.01)
*B05C 3/02* (2006.01)

(52) U.S. Cl.
CPC ..... *C23C 2/20* (2013.01); *B05C 3/02* (2013.01); *C23C 2/40* (2013.01)

(58) Field of Classification Search
None
See application file for complete search history.

(56) References Cited

U.S. PATENT DOCUMENTS

2004/0050323 A1* 3/2004 Chae ..... C23C 2/20 118/400
2008/0026134 A1* 1/2008 Kayama ..... C23C 2/14 427/9

FOREIGN PATENT DOCUMENTS

JP 3-253549 A 11/1991
JP 2008-280587 A 11/2008
JP 2009-275266 A 11/2009

* cited by examiner

*Primary Examiner* — Jethro M. Pence
(74) *Attorney, Agent, or Firm* — Crowell & Moring LLP

(57) ABSTRACT

A coating weight control apparatus includes: a strip passing position movement amount estimate part configured to estimate an movement amount of a strip passing position, in response to any of activation factors for movement of a strip passing position, that is, a welding point passing, a change in tension, and an operation of a correcting roll; and a nozzle position control part configured to shift each of positions of a front side nozzle and a back side nozzle by an amount corresponding to the movement amount of the strip passing position estimated by the strip passing position movement amount estimate part.

8 Claims, 10 Drawing Sheets

201

| Item | Value | Item | Value |
|---|---|---|---|
| strip identification | KYR1960021 | coating type | GA |
| Steel grade | A | nozzle gap | a |
| strip thickness | 0.8mm | correcting roll position | b |
| strip width | 1200mm | strip tension | c |
| target coating weight | B | strip length | d |
| maximum coating weight | C | ⋮ | ⋮ |
| minimum coating weight | E | | |

TL: coating weight on front left side of strip
TC: coating weight on front center of strip
TR: coating weight on front right side of strip BL: coating weight on back left side of strip
BC: coating weight on back center of strip
BR: coating weight on back right side of strip

COATING WEIGHT CONTROL APPARATUS AND COATING WEIGHT CONTROL METHOD

CROSS REFERENCE TO RELATED APPLICATION

This application claims the benefit of Japanese Patent Application No. 2018-248025 filed on Dec. 28, 2018, the disclosure of which is incorporated herein by reference.

BACKGROUND OF THE INVENTION

1. Field of the Invention

The present invention relates to a coating weight control apparatus and a coating weight control method, in each of which a hot-dip coating bath in a desired thickness is attached to a steel strip in a continuous coating plant of a steel line. The present invention is in particular directed to the coating weight control method in which, when a coating weight is controlled by automatically controlling not only a pressure of a nozzle but also a position thereof, coating weights on both a front and a back sides of a strip can be controlled to respective target values, and the control can be continued in safety by minimizing a risk that the nozzle and the strip come in contact with each other.

2. Description of the Related Art

An operation element for controlling a coating weight attached to a strip includes a nozzle pressure and a nozzle position. The nozzle position is an operation element for changing a distance between a nozzle and a strip (to be also referred to as a nozzle gap hereinafter). A nozzle position operation is generally excellent in responsiveness to a control or brilliance of a coated strip. It is not, however, easy to determine an exact distance between the nozzle and the strip because a relative position of the strip with respect to the nozzle may fluctuate due to various factors such as a change in strip thickness. Thus, the nozzle position is often controlled manually by an operator. In order to introduce automatic control, it is required to prevent such risks that: accuracy in a coating weight becomes reduced; coating weights on a front and a back sides of a strip is not well-balanced; and the nozzle and the strip disadvantageously come in contact with each other.

There have been known conventional techniques for controlling a coating weight. Japanese Laid-Open Patent Application, Publication No. 2008-280587 (to be also referred to as Patent Document 1 hereinafter) discloses a technique in which: a sensor for detecting a position in a nozzle at which a strip passes therethrough (a strip passing position) is arranged; and an appropriate control of respective positions of a front and a back side nozzles constituting the nozzle is provided with respect to the strip, using the strip passing position detected by the sensor.

Japanese Laid-Open Patent Application, Publication No. 2009-275266 (to be also referred to as Patent Document 2 hereinafter) discloses a technique in which: a unit for estimating a strip passing position is provided; and, when an estimated distance between a nozzle and a strip is equal to or smaller than a prescribed value, a nozzle gap is corrected or an alarm is given.

Japanese Laid-Open Patent Application, Publication No. H03-253549 (to be also referred to as Patent Document 3 hereinafter) discloses a technique in which: a magnetic force generator capable of controlling a strip contactlessly and a displacement gauge capable of detecting a strip passing position are provided above and below a nozzle; the strip is controlled to be situated in an appropriate position, using a value measured by the displacement gauge; and a distance between the nozzle and the strip is controlled such that a desired coating weight can be obtained.

PRIOR ART DOCUMENTS

Patent Documents

[Patent Document 1] Japanese Laid-Open Patent Application, Publication No. 2008-280587

[Patent Document 2] Japanese Laid-Open Patent Application, Publication No. 2009-275266

[Patent Document 3] Japanese Laid-Open Patent Application, Publication No. H03-253549

SUMMARY OF THE INVENTION

When the technique of Patent Document 1 is used, however, it becomes necessary to install a sensor for detecting a strip passing position. This makes cost of a system of interest higher and also requires additional maintenance or calibration operation of the sensor. Also, accuracy of a coating weight in coating can be reduced, because the sensor for detecting a strip passing position is typically disposed in an upper portion of the nozzle, and the strip passing position detected by the sensor may not be exactly the same as an actual strip passing position of the nozzle. Further, detection of a strip passing position in a coating plant has a highly technological difficulty because of vibration or warp in a width direction of the strip, which makes it difficult to detect the strip passing position with high accuracy.

In the technique of Patent Document 2, a unit is provided which: estimates a change in a strip passing position when a strip thickness has changed; and further estimates the strip passing position by determining a state whether or not a control is being stable. The strip passing position is, however, moved not only when the strip thickness has changed but also when a position of a correcting roll (including a stabilizing roller) has been operated, or a tension of the strip has changed. Patent Document 2 fails to take those factors into consideration. Thus, accuracy in estimating a strip passing position is reduced from when the correcting roll position is operated or the tension changes until when a stable control is established. Further, relationship between an amount of strip thickness and an movement amount of a strip passing position is influenced by various state quantities as operating points, such as a strip thickness, a steel grade, a correcting roll position, and a tension value of each of a currently-treated strip (a current strip) and a strip to be treated next (a next strip). For example, strips of different steel grades have different hardness or different yield strength, which influences the movement amount of a strip passing position. Without taking the influence of the state quantities into consideration, Patent Document 2 may have such a problem that accuracy in estimating a strip passing position is reduced.

The technique of Patent Document 3 requires a large-scale equipment for restraining a strip, which increases cost of a system of interest.

In light of the problems described above, the present invention has been made in an attempt to, when a position of a nozzle is automatically controlled: estimate a movement amount of a strip passing position without using a special sensor for detecting the strip passing position; and to control the nozzle position based on the estimated result. This can also prevent imbalanced coating weights between a front and a back sides of the strip, resulting in a highly accurate control of the coating weights, and also prevent the nozzle and the strip from coming into contact with each other, which results in a continued safe control.

In solving the problems described above, the present invention provides a coating weight control apparatus that provides control on a coating plant in which a series of continuously-fed strips in which two adjacent strips are welded at a welding point: are immersed in a pot of a hot-dip coating bath so as to coat the strips with the hot-dip coating bath; are removed therefrom; are sprayed with gas from each of a front side nozzle and a back side nozzle facing a front side and a back side of the strips, respectively; and are subjected to removal of excessive hot-dip coating bath, to thereby coat the strips with the hot-dip coating bath in a desired thickness. The coating weight control apparatus includes: a coating weight prediction model in which relationships among a speed of the strips, respective pressures of the nozzles, respective distances between each of the nozzles and the strips, and a coating weight which is an amount of the hot-dip coating bath coated on the strips are described; a controller configured to control at least one of the pressures of the nozzles and respective positions of the nozzles such that, by referencing the coating weight prediction model, the coating weight of the hot-dip coating bath coated on the strips takes a desired value; and a strip passing position movement amount estimate part configured to estimate a movement amount of a strip passing position, the strip passing position being a position at which the strips pass through with respect to a height of the any one of the nozzles, when at least one of the following changes, (1) thicknesses between two adjacent strips across a welding point, (2) tensions of the strips, and (3) a position of a correcting roll that supports the strips in the pot, and to then output the estimated movement amount to the controller.

A strip passing position is moved when any of the following factors occurs: a welding point passing; a change in tension; and an operation of a correcting roll position. In the present invention, in response to the occurrence, a strip passing position movement amount estimate part is activated and calculates a movement amount of a strip passing position corresponding to any of the factors. A nozzle position control part shifts each of a front and a back side nozzle positions, based on the movement amount of a strip passing position. A relative distance between a nozzle and a strip can be thus kept constant. This makes it possible to prevent imbalanced coating weights on a front and a back sides of the strip caused by the strip passing position movement. This also makes it possible to reduce a risk that, when the strip comes close to either the front or the back side nozzle, the nozzle and the strip disadvantageously come into contact.

Further, in the present invention, a safe distance without the contact risk between the nozzle and the strip is inputted as an allowable nozzle gap. Control of a nozzle position is provided in a range in which the nozzle and the strip do not come in contact with each other, using the allowable nozzle gap. This makes it possible to eliminate a risk of the contact between the nozzle and the strip, which results in a continued safe control.

DETAILED DESCRIPTION OF THE EMBODIMENTS

In a control of a coating weight to be described in the following embodiments, automatic control of a nozzle gap can be used in safety. Compared to an automatic control of a nozzle pressure alone, the control to be described in the embodiments can achieve excellent accuracy and responsiveness in the coating weight control, and an improved quality of a strip surface.

First Embodiment

Figure 1:
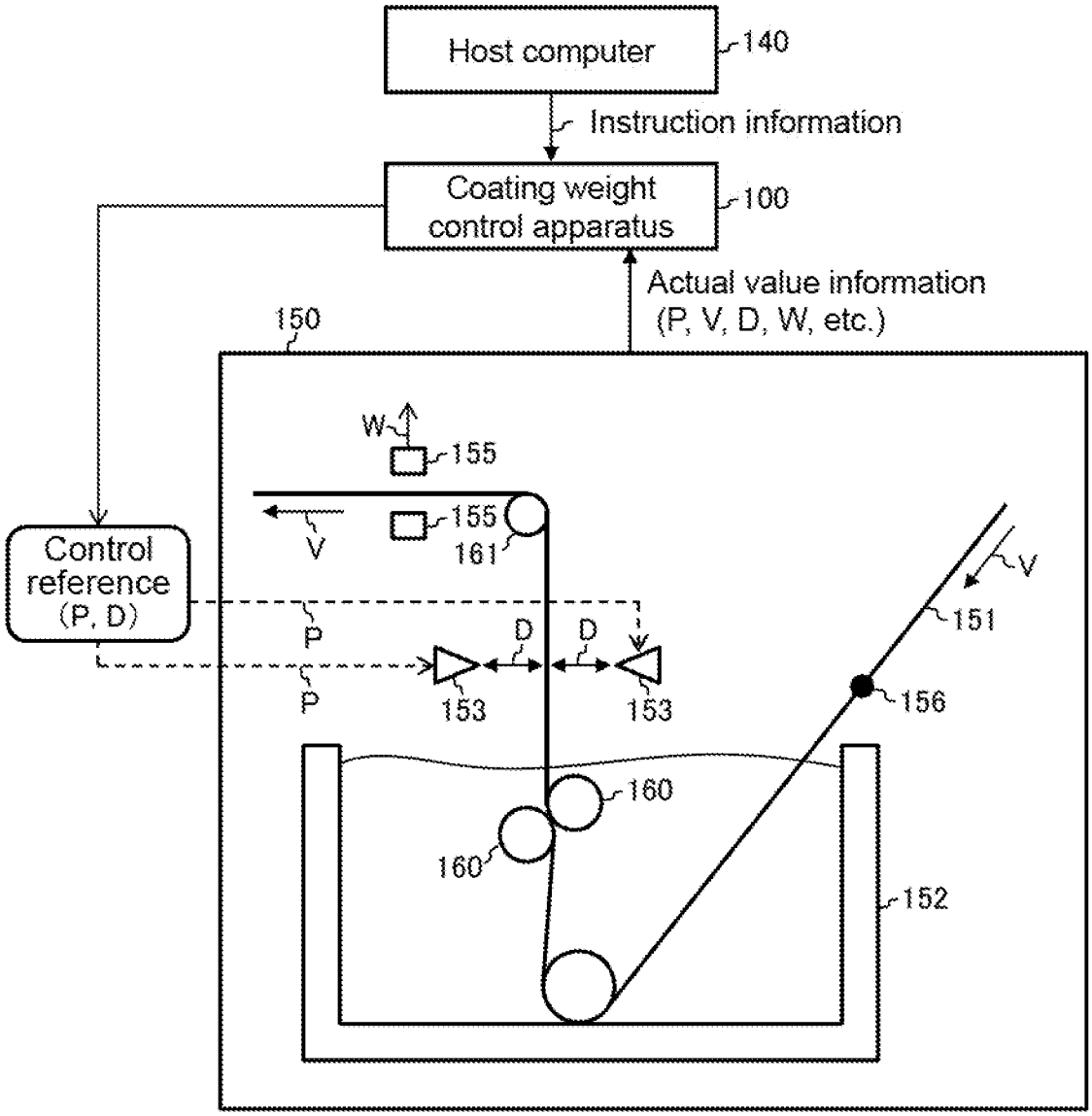
FIG. 1 is an explanatory diagram illustrating a coating plant according to a first embodiment of the present invention.

FIG. 1 is an explanatory diagram illustrating a coating plant according to an embodiment of the present invention. A coating weight control apparatus 100 (see FIG. 12 for details) controls a coating plant 150, and a strip 151 is thereby coated with a hot-dip bath in a desired thickness.

The coating plant 150 is described below. A pot (bath) 152 of the coating plant 150 is filled with a hot-dip bath, into which a series of strips 151 in which adjacent strips are welded at a welding point 156 are fed one after another. The strip 151 supported by a correcting roll 160 composed of two rolls and is controlled so as to have a constant tension value between the correcting roll 160 and a top roll 161. When one strip 151 currently being treated is fed and another to be treated next follows across the welding point 156, tension is changed, that is, tension before the welding point 156 is that of the currently-treated strip 151, and, after, that of the next strip 151.

The strip 151: is immersed in the hot-dip coating bath; is removed therefrom; is sprayed with gas from a nozzle 153 which is composed of a front side nozzle and a back side nozzle facing a front side and a back side of the strip 151, respectively; and is subjected to removal of excessive hot-dip coating bath. This makes it possible to control a coating weight coated on the strip 151 in a desired amount. Major factors that determine the coating weight coated on the strip 151 include a speed of the strip 151 (a strip speed), a pressure of gas sprayed from the nozzle 153, and a distance between the nozzle 153 and the strip 151. A pressure of the front side nozzle and that of the back side nozzle are typically made the same, taking vibration of the strip 151 into consideration. This means that, if a position of the nozzle 153 is controlled such that the strip 151 is situated in an intermediate position between the front side nozzle and the back side nozzle, respective coating weights on the front and back sides of the strip 151 can be made the same.

A position at which the strip 151 during coating passes through, with respect to a height of the nozzle 153, is hereinafter referred to as a "strip passing position". A distance between the nozzle 153 and the strip passing position is referred to as a nozzle gap. If the strip passing position can be estimated, a relative position of the strip 151 with respect to the nozzle 153 can be determined. That is, a front side nozzle gap can be calculated from a front side nozzle position and a strip passing position thereof; and a back side nozzle gap, from a back side nozzle position and a strip passing position thereof.

Adjustment of the correcting roll 160 makes it possible to change warp of the strip 151 in a width direction thereof. Warp of the strip 151 may cause different coating weights of the strip 151 in the width direction thereof. Undesirable different coating weights can be prevented by controlling a position of the correcting roll 160 such that the strip 151 is not warped.

Meanwhile, the strip passing position varies according to a change in a thickness or a tension of the strip 151, or adjustment of the correcting roll 160. If the strip passing position changes, the strip 151 comes closer to one of the front and back side nozzles and away from the other. When respective target values of coating weights on a front and a back sides of the strip 153 are the same, it is required that a position of the nozzle 153 is controlled such that the strip 151 is situated in an intermediate position between the front side nozzle and the back side nozzle, even when a strip passing position is moved. When differential thickness coating is performed in which coating weights on the front and the back sides are intentionally made different, control of the nozzle 153 is required such that the nozzle 153 is situated in a position taking a difference in coating weight target values on the two sides into account. In either case, it is necessary to make a correct estimate of a movement amount of a strip passing position and shift a position of the nozzle 153 by the estimated movement amount of the strip passing position at a timing when the strip passing position is moved, in order to maintain well-balanced coating weights on the two sides.

Relationship between a coating weight with which the strip 151 is coated, a strip speed, a nozzle pressure, and a nozzle gap (a distance between a nozzle and a strip) is represented by, for example, Formula 1 below. In Formula 1, when respective values on a strip front side are entered into P and D, a coating weight on the strip front side can be calculated. When respective values on a strip back side are entered into P and D, a coating weight on the strip back side can be calculated. Further, when an average value of Ps of the coating weights on the two sides and an average value of Ds thereof, an approximate average coating weight on the two sides can be calculated.

$$In(W)=f(P,V,D)=a0+a1\times In(P)+a2\times In(V)+a3\times In(D) \quad \text{[Formula 1]}$$

wherein, W: coating weight, P: nozzle pressure, V: strip speed, D: a nozzle gap; and a0 to a3: coefficients.

In this embodiment, Formula 1 may also be hereinafter referred to as a coating weight prediction model. In the coating weight prediction model, any other factors such as a nozzle height, a temperature of the strip 151, and a temperature of a hot-dip coating bath may also be taken into consideration. As described above, one strip 151 is welded to another 151 at the welding point 156. The welding point 156 is usually a point at which a target coating weight changes from one to another. A coating weight detector 155 is a device which measures an actual coating weight coated on the strip 151. The coating weight detector 155: detects how much coating weight is coated on each of the front and the back sides of the strip 151; and outputs the detected coating weights. In this embodiment, description is made assuming an example in which three measurement values on a left side, a center, and a right side points in a width direction for each of the front and the back sides of the strip 151 (six points in total) are outputted. The coating weight detector 155 is disposed several tens to a hundred and several tens meters away from the nozzle 153. Generally, the strip 151: is then moved in the width direction; is subjected to an average processing; and outputs a resultant value. Therefore, it usually takes several tens of seconds to two minutes to complete measurement of respective coating weights corresponding to P, V, and D of the nozzle position.

Figure 12:
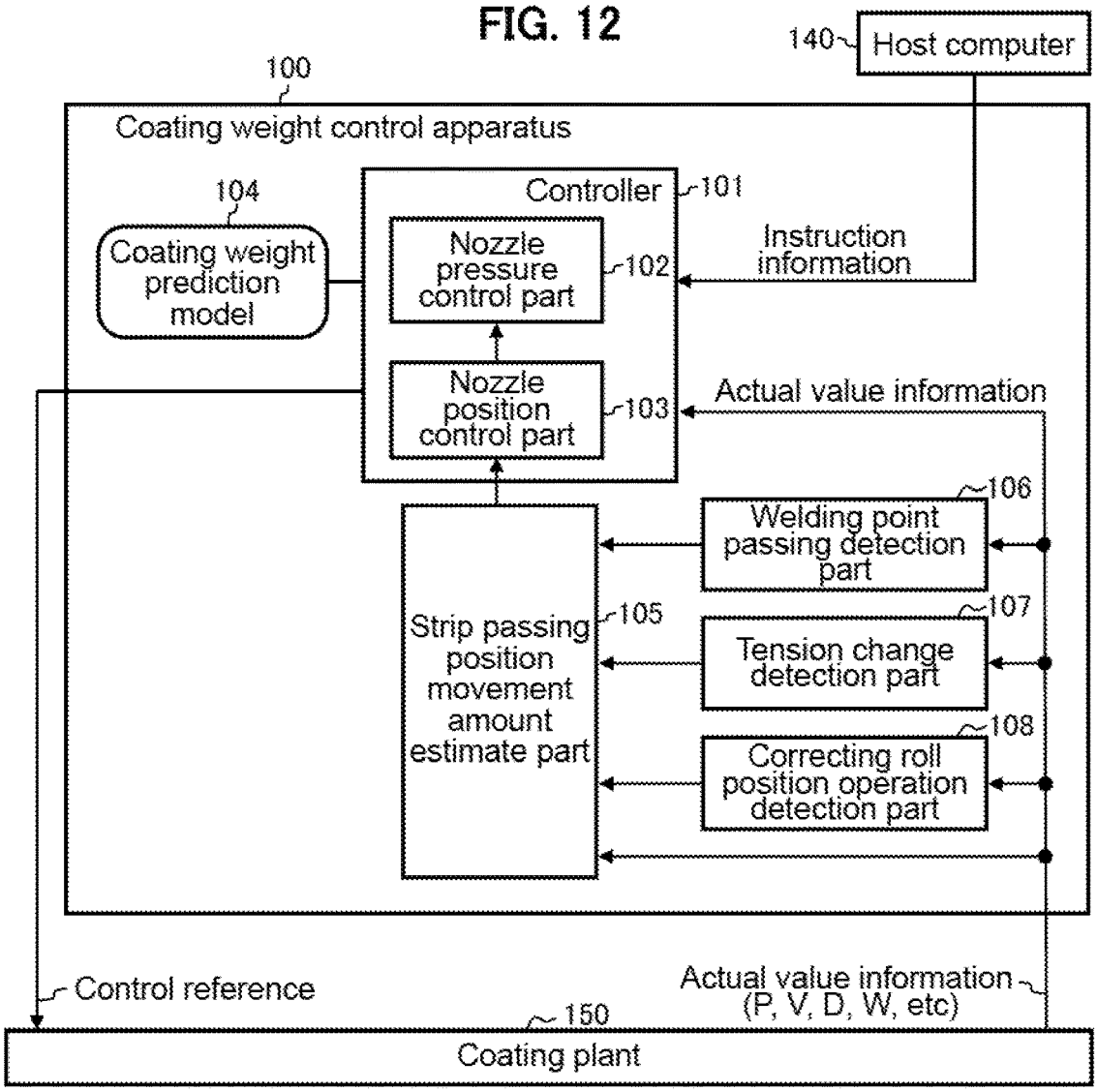
FIG. 12 is a block diagram illustrating a configuration of a coating weight control apparatus according to the first embodiment.

FIG. 12 illustrates a detailed configuration of the coating weight control apparatus 100. The coating weight control apparatus 100 includes a controller 101 that: receives instruction information which is information containing an identification, asteel grade, a thickness, a width, a coating weight target value, and the like of the strip 151 to be treated next, from the host computer 140; and also receives a pressure and a position of the nozzle 153, a speed of the strip 151, and actual value information such as an actual coating weight detected by the coating weight detector 155, or the like, from the coating plant 150. Based on the above-described information, the controller 101 references the coating weight prediction model 104 using the above-described information; and calculates an instruction on a pressure or a position of the nozzle 153 so as to achieve the target coating weight. The controller 101 includes a nozzle pressure control part 102 and a nozzle position control part 103. The controller 101 also includes: a welding point passing detection part 106 that detects whether or not the welding point 156 has already passed a position of the nozzle 153, from the actual value information acquired from the coating plant 150; a tension change detection part 107 that detects whether or not a tension of the strip 151 has changed; a correcting roll position operation detection part 108 that detects whether or not an operator has operated the correcting roll 160; and a strip passing position movement amount estimate part 105 that estimates a movement amount of a strip passing position, following a result detected by any of the welding point passing detection part 106, the tension change detection part 107, and the correcting roll position operation detection part 108. The nozzle position control part 103 shifts a position of the nozzle 153 in response to an output from the strip passing position movement amount estimate part 105.

Figures 2, 3:
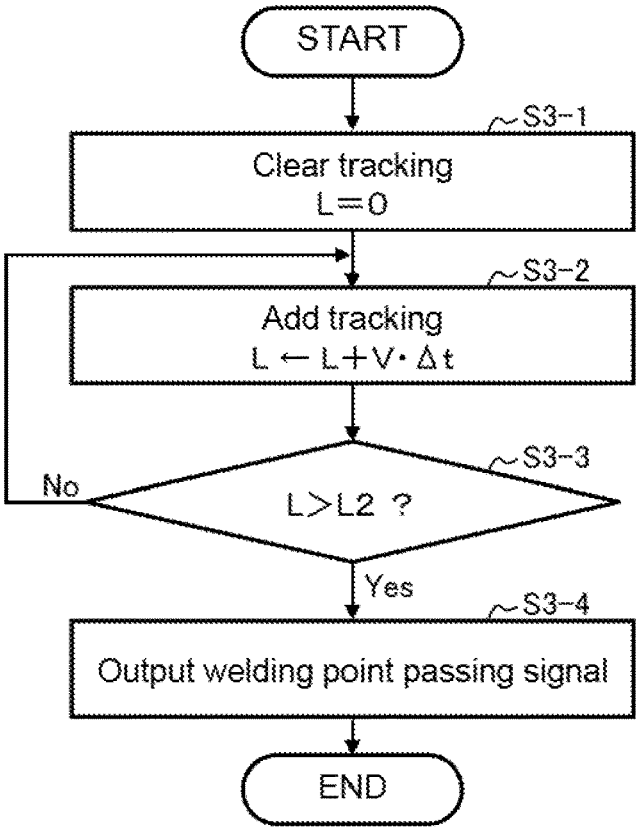
FIG. 2 is a table illustrating an example of instruction information according to the first embodiment.
FIG. 3 is a flowchart illustrating a processing performed by a welding point passing detection part according to the first embodiment.

How components in this embodiment work is detailed below with reference to related drawings. FIG. 2 illustrates an example of instruction information 201 which the coating weight control apparatus 100 receives from the host computer 140. The instruction information 201 is composed of such basic information as an identification, a steel grade, a thickness, a width, and a length of the strip 151 to be treated next, as well as a target value for appropriate controlling, or the like. The instruction information 201 is transmitted to the coating weight control apparatus 100 before the strip 151 of interest is treated. The example of the instruction information 201 illustrated in FIG. 2 also contains: attribute values of the identification, the steel grade, the thickness, the width, and the like; control instruction values such as a target coating weight, a maximum coating weight, and a minimum coating weight; operating points of controlling, such as a nozzle gap, a position of the correcting roll 160, and the like. In some cases, the instruction information 201 also contains a chemical composition or a delivery destination of the strip 151, information on an operation to be performed next, or the like.

FIG. 3 illustrates a flowchart of a processing performed by the welding point passing detection part 106. The processing starts at a timing when the welding point 156 has passed through a position of the nozzle 153 and is repeatedly performed on a fixed (Δt) cycle. In S3-1, a tracking value L is initialized. In the flowchart, L indicates a distance between a currently-being-coated portion and a head of the strip 151. In S3-2, a speed of the strip 151 is acquired from the coating plant 150. A value obtained by multiplying a strip speed V and a calculation cycle Δt is then added to L. The resultant value is taken as a new L. In S3-3, it is determined whether or not L is larger than a strip length L2 acquired from the instruction information 201. If L is not determined to be larger than the strip length L2, which means that the strip 151 is still being treated, the processing returns to S3-2 after a lapse of Δt and S3-2 to S3-3 are repeated. If L is determined to be larger than the strip length L2, which means that the coating of the strip 151 has already been completed, in S3-4, the result obtained by determining whether or not the welding point has been passed through is outputted to the strip passing position movement amount estimate part 105. The processing is then returned to S3-1 and another processing to the strip 151 to be treated next is started.

Figure 4:
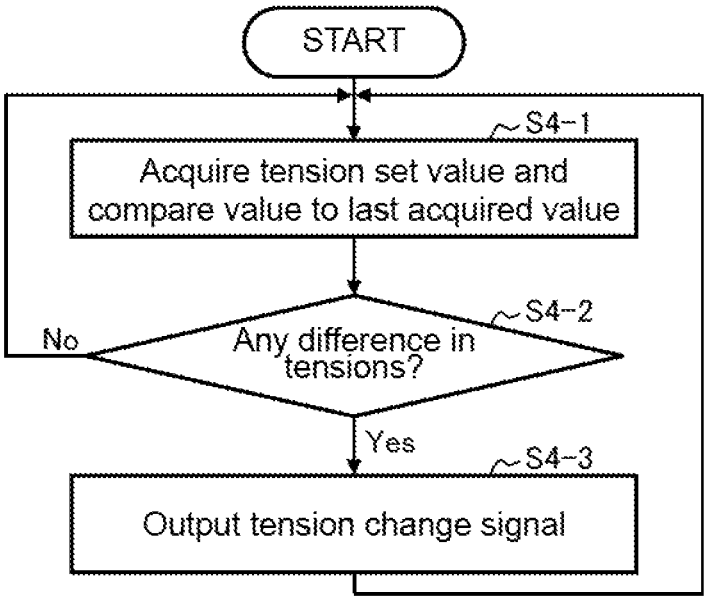
FIG. 4 is a flowchart illustrating a processing performed by a tension change detection part according to the first embodiment.

FIG. 4 is a flowchart illustrating a processing performed by the tension change detection part 107. In S4-1, a tension of the strip 151 between the correcting roll 160 and the top roll 161 is acquired from the coating plant 150, and the tension is compared to that acquired last time. If there is no difference between the two compared tensions, the processing returns to S4-1 because there has been no change in the tension, and S4-2 to S4-3 are repeated. If there is a difference between the two compared tensions, which means that the tension has changed, in S4-3, the detected result that the tension has changed is outputted to the strip passing position movement amount estimate part 105. The processing then returns to S4-1 and a possible change in the tension is monitored.

Figure 5:
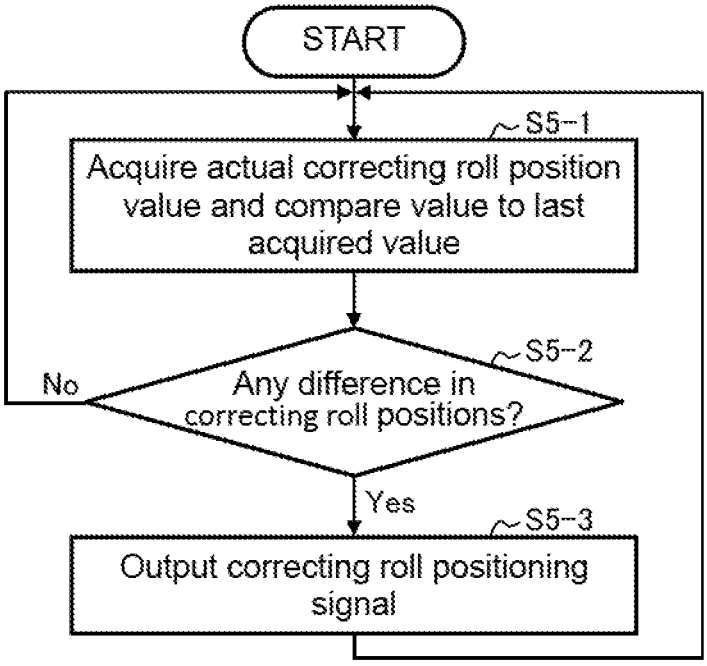
FIG. 5 is a flowchart illustrating a processing performed by correcting roll position operation detection part according to the first embodiment.

FIG. 5 is a flowchart illustrating a processing performed by the correcting roll position operation detection part 108. In S5-1, a position value of the correcting roll 160 is acquired from the coating plant 150 and is compared to that acquired last time. At least one of the two rolls of the correcting roll 160 used herein can be moved in a horizontal direction. A position of the correcting roll 160 is a position of the at least one of the rolls movable in the horizontal direction or an intermesh amount which is an amount of overlapping of the two rolls of the correcting roll 160 in an up-and-down direction.

If there is no difference between the two compared positions, which means that the correcting roll 160 has not been operated, the processing returns to S5-1 and repeats S5-2 to S5-3. If there is a difference between the two compared positions, which means that the correcting roll 160 has been operated and the position thereof has changed, then in S5-3, the detected result that the correcting roll 160 has been operated is outputted to the strip passing position movement amount estimate part 105. The processing then returns to S5-1 and a possible operation of the correcting roll 160 to be performed next is monitored.

Figure 6:
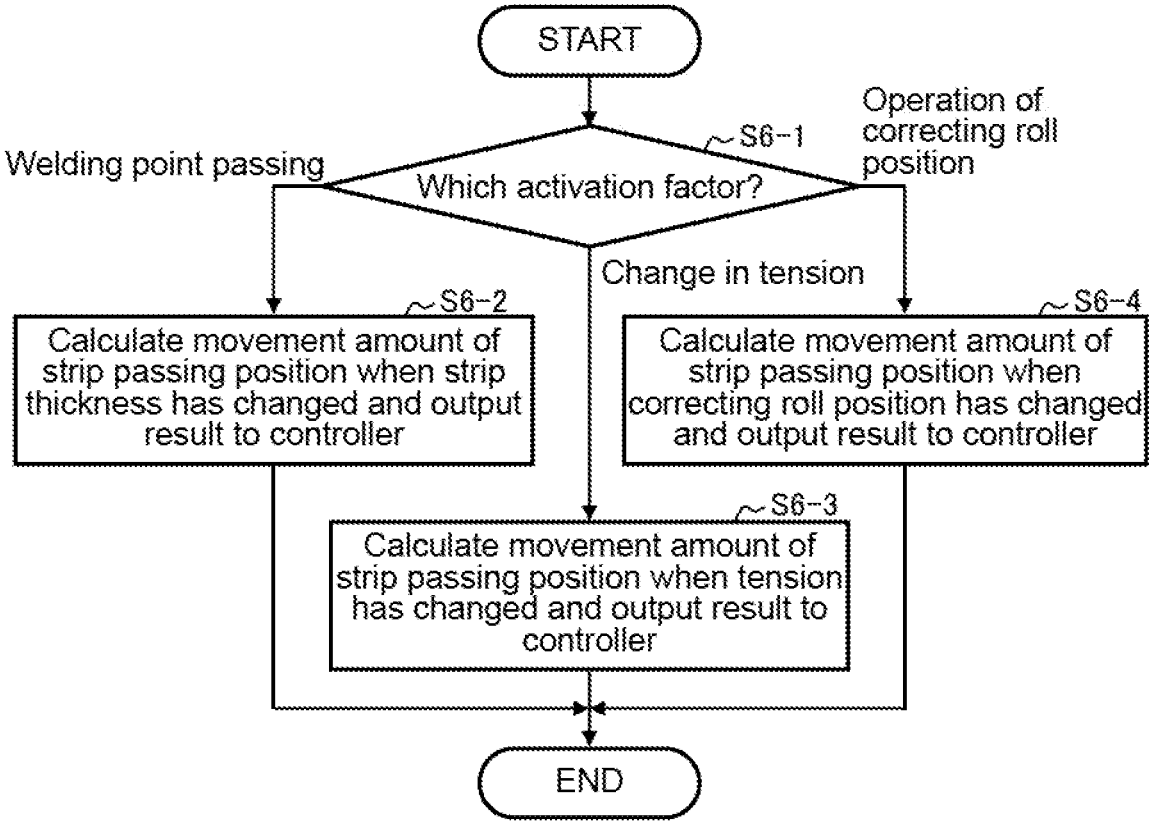
FIG. 6 is a flowchart illustrating a processing performed by a strip passing position movement amount estimate part according to the first embodiment.

FIG. 6 is a flowchart illustrating a processing performed by the strip passing position movement amount estimate part 105. In S6-1, an activation factor is detected. The activation factor herein: is a cause for a change in a position of the strip 151. In this embodiment, the activation factor is any of a passing across the welding point 156, a change in tension of the strip 151, and an operation of the correcting roll 160. The activation factor is detected by using a signal from one of the welding point passing detection part 106, the tension change detection part 107, and the correcting roll position operation detection part 108. When it is determined that a signal representing the passing of the welding point 156 is received from the welding point passing detection part 106, the processing advances to S6-2, in which a movement amount of a strip passing position is calculated when a strip thickness has changed and the calculated result is outputted to the nozzle position control part 103 of the controller 101. A movement amount of the strip passing position ΔPos_th along with a change in the strip thickness is calculated by, for example, Formula 2.

$$\Delta Pos_th = g(THb, \mathrm{Ccur}, Stb, \mathrm{TEN}cur) - g(THf, \mathrm{Ccur}, Stf, \mathrm{TEN}cur) \quad \text{[Formula 2]}$$

wherein THb: thickness of following strip, THf: thickness of preceding strip, Ccur: position of correcting roll, Stb: yield strength of following strip, Stf: yield strength of preceding strip, and TENcur: strip tension.

In Formula 2, a first term of a right side shows a strip passing position after a change in a strip thickness; and, a second term, that before the change in the strip thickness. Each of the terms is represented by respective functions of the strip thickness, a position of the correcting roll 160, a strip yield strength, and a strip tension. Passing of the welding point 156 causes a change in the strip thickness and steel grade. In response to the change, an amount of strip passing position change ΔPos_th can be obtained by calculating a difference between the first and the second terms. The strip yield strength can be substituted by a strip tensile strength or hardness. In S6-1, if it is determined that a signal indicating a change in the tension is received from the tension change detection part 107, the processing advances to S6-3, in which a movement amount of the strip passing position is calculated when the tension has changed and is outputted to the nozzle position control part 103 of the controller 101. An movement amount of a strip passing position ΔPos_ten along with a change in the tension can be obtained by, for example, evaluating Formula 3.

$$\Delta Pos_\mathrm{ten} = h1(TH, \mathrm{Ccur}, St, \mathrm{TEN}cur) - h1(TH, \mathrm{Ccur}, St, \mathrm{TEN}pre) \quad \text{[Formula 3]}$$

wherein TH: strip thickness, Ccur: correcting roll position, St: strip yield strength, TENcur: strip tension after change, and TENpre: strip tension before change.

In Formula 3, a first term of a right side shows a strip passing position after a change in tension; and, a second term, that before the change in tension. Each of the terms is represented by respective functions of the strip thickness, a position of the correcting roll 160, a strip yield strength, and a strip tension. The tension changes from TENpre to TENcur, and an amount of the strip passing position change ΔPos_ten corresponding to the change in tension can be obtained by calculating a difference between the first and the second terms. The amount of the strip passing position change ΔPos_ten can be obtained by evaluating a formula using an amount of change in tension, such as Formula 4.

$$\Delta Pos_\mathrm{ten}=h2(\Delta\mathrm{TEN},TH,St,\mathrm{Ccur}) \quad \text{[Formula 4]}$$

wherein ΔTEN: amount of change in tension.

In S6-1, if it is determined that a signal indicating that the correcting roll 160 has been operated, from the correcting roll position operation detection part 108, the processing advances to S6-4, in which a movement amount of a strip passing position when the position of the correcting roll 160 has changed is calculated and is then outputted to the nozzle position control part 103 of the controller 101. A movement amount of a strip passing position ΔPos_croll along with a change in the position of the correcting roll 160 can be obtained by, for example, evaluating Formula 5.

$$\Delta Pos_croll=e1(TH,\mathrm{Ccur},St,\mathrm{TEN}cur)-e1(TH,\mathrm{Cpre},St,\mathrm{TEN}cur) \quad \text{[Formula 5]}$$

wherein Ccur: position of correcting roll after being operated, and Cpre: position of correcting roll before being operated.

In Formula 5, a first term of a right side shows a strip passing position after the correcting roll 160 is operated; and, a second term, that before the correcting roll 160 is operated. Each of the terms is represented by respective functions of a strip thickness, a position of the correcting roll 160, a strip yield strength, and a strip tension. The position of the correcting roll 160 changes from Cpre to Ccur, and an amount of a strip passing position change ΔPos_croll corresponding to the change in the correcting roll position can be obtained by calculating a difference between the first and the second terms. The amount of the strip passing position change ΔPos_croll along with the change in the correcting roll position can also be obtained by evaluating a formula using an amount of change in the correcting roll position, such as Formula 6.

$$\Delta Pos_croll=e2(\Delta C,TH,St,\mathrm{TEN}) \quad \text{[Formula 6]}$$

wherein ΔC: amount of change in correcting roll position.

Figure 7:
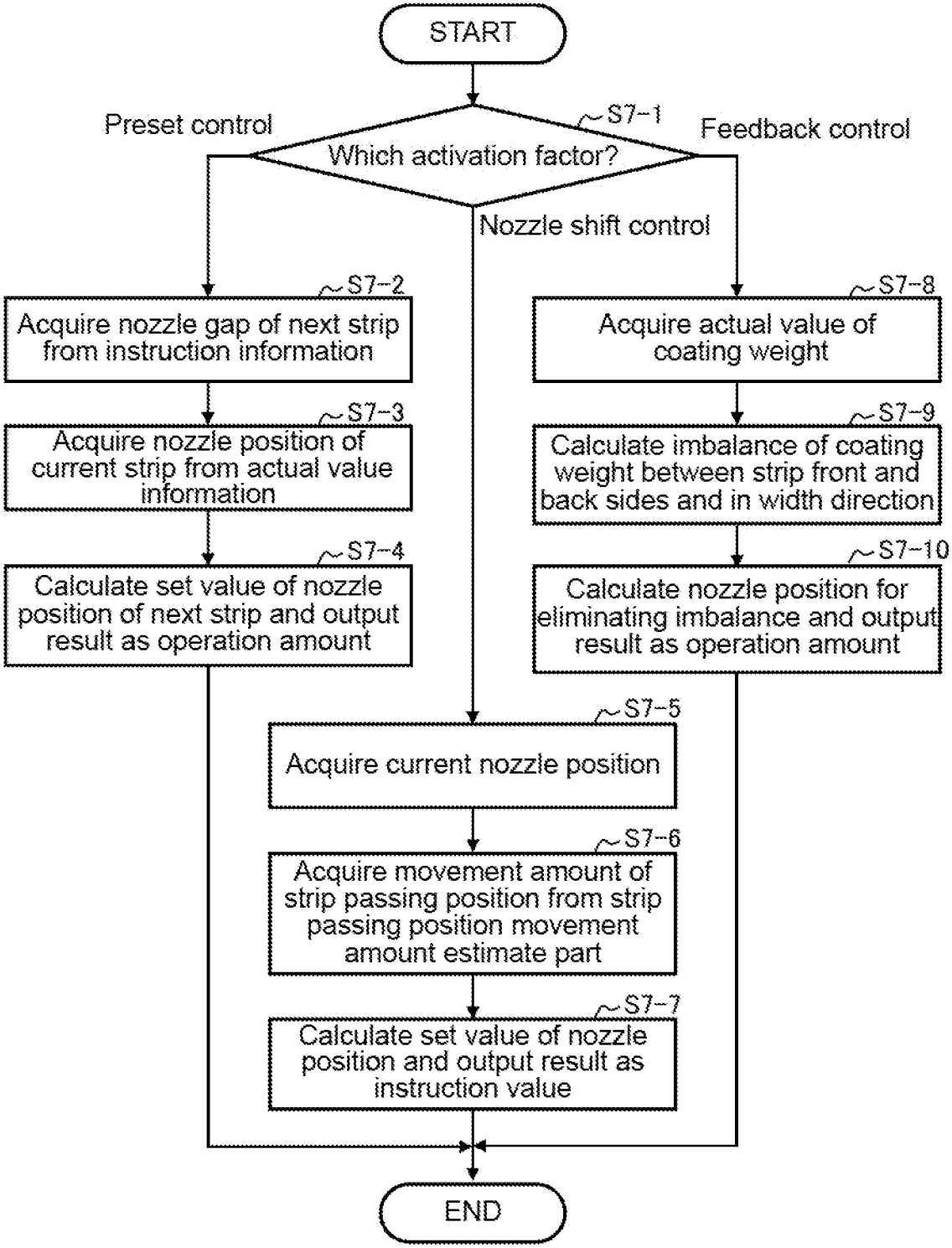
FIG. 7 is a flowchart illustrating a processing performed by a nozzle position control part according to the first embodiment.
Figure 13:
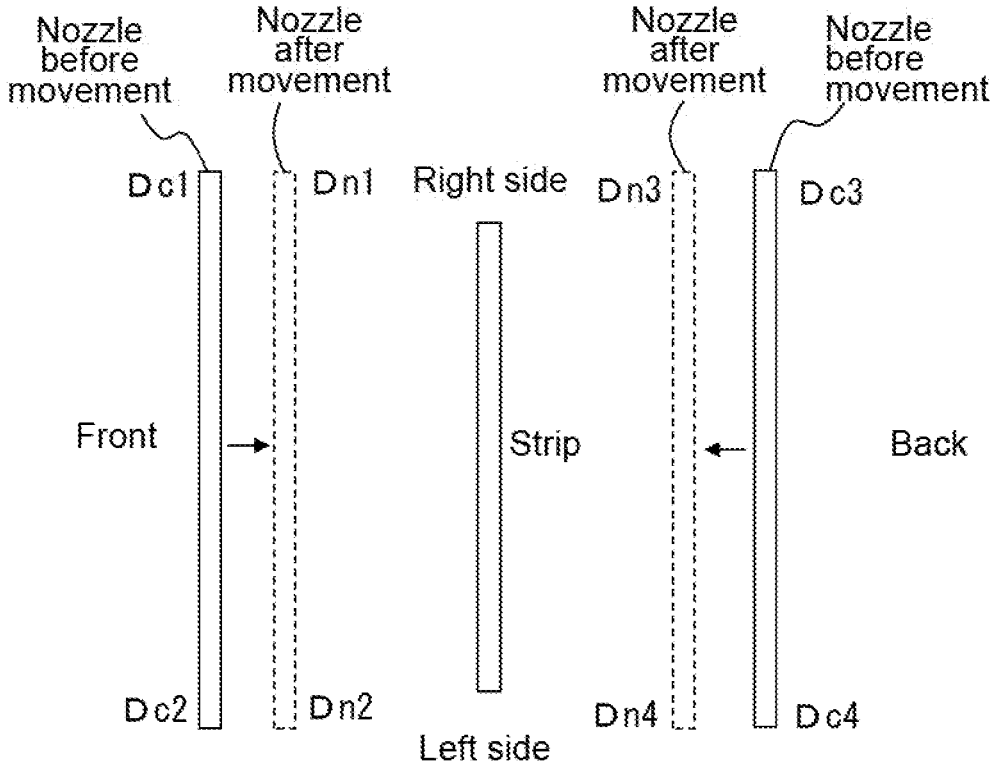
FIG. 13 is a horizontal sectional diagram illustrating a nozzle and a strip for explaining a positional relationship therebetween according to the first embodiment.

FIG. 7 is a flowchart illustrating a processing performed by the nozzle position control part 103 of the controller 101. The nozzle position control part 103 provides three types of controls, namely, preset control, nozzle shift control, and feedback control in accordance with the instruction information 201 on the strip 151 received from the host computer 140. Under the preset control, a position of the nozzle 153 suitable for obtaining a target coating weight is set. Under the nozzle shift control: information on movement of a strip passing position is acquired from the strip passing position movement amount estimate part 105; and the nozzle 153 made up of the front side nozzle and the back side nozzle is shifted in parallel by a value corresponding to the acquired information. Under the feedback control: imbalanced coating weights between the front and the back side strips or in the width direction thereof are detected based on an actual coating weight acquired from the coating weight detector 155; and the nozzle position is shifted in such a direction that the imbalance is reduced. In S7-1, which activation factor is to be provided is determined from among the preset control, the nozzle shift control, and the feedback control. The activation factor is determined from the actual value information acquired from the coating plant 150. For example, what is determined as the activation factor is: in the preset control, that the welding point 156 has passed through a position of the nozzle 153; in the nozzle shift control, that the information on movement of a strip passing position is received from the strip passing position movement amount estimate part 105; and, in the feedback control, that a new coating weight is detected by the coating weight detector 155. When the preset control is activated, in S7-2, a nozzle gap Dn of the strip 151 to be treated next is acquired from the instruction information. In S7-3, nozzle positions Dc1 to Dc4 for controlling the currently-being-treated strip 151 are acquired as the actual value information from the coating plant 150. In this embodiment, description is made assuming an example in which four actuators for controlling a position of the nozzle 153 are disposed right and left of each of the front and the back side nozzles. The nozzle position on the right side of the front side nozzle is referred to as Dc1; on the left side thereof, Dc2; on the right side of the back side nozzle, Dc3; and on the left side thereof, Dc4. In S7-4, nozzle positions Dn1 to Dn4 of the strip 151 to be treated next are calculated according to Formula 7 to Formula 10 and are outputted to the coating plant 150. Please refer to FIG. 13 for respective parameters in Formula 7 to Formula 10 (Dc: nozzle position to currently-treated strip before movement, and Dn: nozzle position to strip to be treated next after movement).

$$Dn1=Dc1+Dn-(Dc1+Dc2+Dc3+Dc4)/4 \quad \text{[Formula 7]}$$

$$Dn2=Dc2+Dn-(Dc1+Dc2+Dc3+Dc4)/4 \quad \text{[Formula 8]}$$

$$Dn3=Dc3+Dn-(Dc1+Dc2+Dc3+Dc4)/4 \quad \text{[Formula 9]}$$

$$Dn4=Dc4+Dn-(Dc1+Dc2+Dc3+Dc4)/4 \quad \text{[Formula 10]}$$

wherein Dc1 to Dc4: current nozzle positions, Dn: nozzle gap instruction value for strip to be treated next, and Dn1 to Dn4: nozzle gap instruction value for strip to be treated next.

In this embodiment, a timing at which the welding point 156 passes through a position of the nozzle 153 is determined as the activation factor of the preset control. In some cases, however, it is desirable to previously calculate the activation factor, taking a time required for movement of the nozzle 155 into consideration. In those cases, the activation factor may be determined to be a timing at which the welding point 156 passes through the correcting roll 160, or five seconds before the passing through the nozzle position, or the like.

When the activation factor is the movement of a strip passing position, the nozzle shift control is provided. In S7-5, a current nozzle position (nozzle positions Dc1 to Dc4 of the currently-being-treated strip 151) is acquired. In S7-6, a movement amount of a strip passing position ΔDp is acquired from the strip passing position movement amount estimate part 105. In S7-7, in accordance with Formula 11 to Formula 14, each of the actuators for making the nozzle 153 operate is shifted by ΔDp, and computing for shifting the front and back side nozzles in parallel is conducted. That is, ΔDp is subtracted from a position of the front side nozzle and ΔDp is added to a position of the back side nozzle, to thereby calculate nozzle position instruction values Dn1 to Dn4. Then the calculated values Dn1 to Dn4 are outputted to the coating plant 150 and the front and the back side nozzles are thereby shifted in parallel by ΔDp.

$$Dn1=Dc1-\Delta Dp \quad \text{[Formula 11]}$$

$$Dn2=Dc2-\Delta Dp \quad \text{[12]}$$

$$Dn3=Dc3+\Delta Dp \quad \text{[Formula 13]}$$

$$Dn4=Dc4+\Delta Dp \quad \text{[Formula 14]}$$

wherein Dc1 to Dc4: current nozzle position, and Dn1 to Dn4: nozzle position after nozzle shift control is provided.

Figure 14:
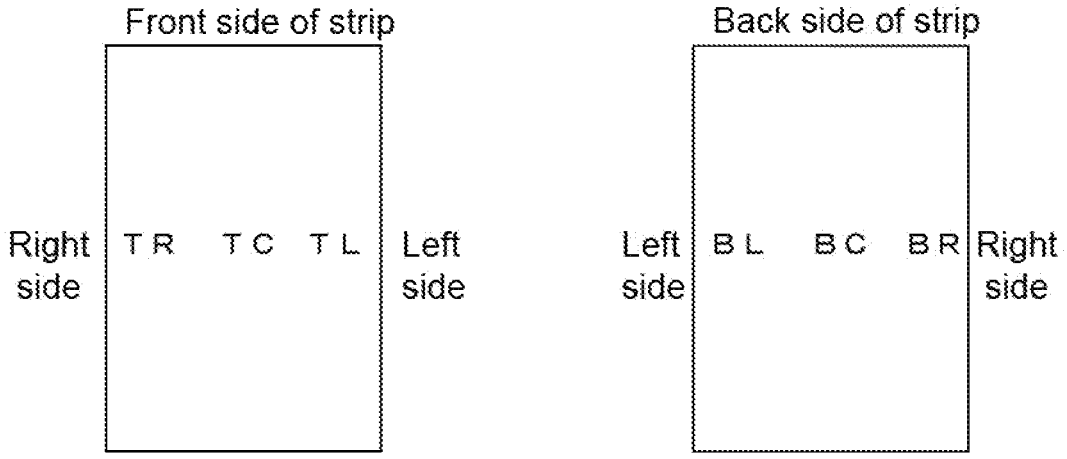
FIG. 14 is a diagram for explaining points at which respective coating weights are measured, where the left side of the figure illustrates a front side of a strip and the right side of the figure illustrates a back side of the strip according to the first embodiment.

When the activation factor is the feedback control, in S7-8, an actual value of a coating weight is acquired from the coating weight detector 155. In this embodiment, description is made assuming an example in which three values on a central and both sides points for each of the front and the back sides of the strip 151 (six points in total) are detected. The six detected values are defined as follows:

TL: coating weight on front left side of strip
TC: coating weight on front center of strip
TR: coating weight on front right side of strip
BL: coating weight on back left side of strip
BC: coating weight on back center of strip
BR: coating weight on back right side of strip In S7-9, imbalance in coating weights between the front and the back sides and in the width direction of the strip 151 is calculated. The imbalance can be calculated by using, for example, Formula 15 and Formula 16. Please refer to FIG. 14 to find parameters in Formula 15 and Formula 16.

$$U=(TR+TC+TL)/3-(BR+BC+BL)/3 \quad \text{[Formula 15]}$$

wherein U: imbalance between front and back sides of strip.

$$G=(TR+BL)/2-(TL+BR)/2 \quad \text{[Formula 16]}$$

wherein G: imbalance in strip width direction.

In the present invention, the coating weight detector 155 measures a coating weight using so-called three-point scanning. More specifically, when the coating weight detector 155 is shifted in the width direction of the strip 151 and then detects a coating weight, the coating weight detector 155: makes three stops at the left, middle, and right positions in the width direction on each of the front and back sides of the strip 151; detects respective coating weights; and outputs the detected values. That is, as described above, six detected measurement values (TL, TC, TR, BL, BC, and BR) on the both sides of the strip 151 are outputted in total.

Also, an average value on the both sides (an average value of the six detected values), an average value on the front side (an average value of TL, TC, and TR), an average value on the back side (an average value of BL, BC, and BR) are usually outputted. In that case, the value U in Formula 15 can be calculated using the front and back side average values.

In some cases, besides the three-point scanning, the coating weight detector 155 is typically operated using full scanning (The coating weight detector 155 detects coating weights while continuously moving in the width direction). The present invention can also be applied to even those cases by using values detected in neighborhood of TL, TC, TR, BL, BC, and BR.

In S7-10, in accordance with Formula 17 to Formula 20, a position of the nozzle 153 by which the imbalance can be solved is calculated; and the calculated nozzle position is outputted to the coating plant 150.

$$Dn1=Dc1+\alpha1\times U-\beta1\times G \quad \text{[Formula 17]}$$

$$Dn2=Dc2+\alpha1\times U+\beta1\times G \quad \text{[Formula 18]}$$

$$Dn3=Dc3-\alpha1\times U+\beta1\times G \quad \text{[Formula 19]}$$

$$Dn4=Dc4-\alpha1\times U-\beta1\times G \quad \text{[Formula 20]}$$

wherein Dc1 to Dc4: current nozzle positions, Dn1 to Dn4: nozzle positions after nozzle shift control is provided, and α1 and β1: control gains.

Before and after passing the welding point 156, a thickness of the strip 151 changes. The preset control and the nozzle shift control may be thus activated at the same time. Even in that case, what to perform is to sequentially execute S7-2 to S7-4 and S7-5 to S7-7 and to multiply the resultant values. Alternatively, Formula 15, Formula 16, and Formula 17 to Formula 20 are superimposed as shown in Formula 21 to Formula 24, to thereby calculate a nozzle position instruction value.

$$Dn1=Dc1+\alpha1\times U-\beta1\times G-\Delta Dp \quad \text{[Formula 21]}$$

$$Dn2=Dc2+\alpha1\times U-\beta1\times G-\Delta Dp \quad \text{[Formula 22]}$$

$$Dn3=Dc3-\alpha1\times U+\beta1\times G+\Delta Dp \quad \text{[Formula 23]}$$

$$Dn4=Dc4-\alpha1\times U-\ominus1\times G+\Delta Dp \quad \text{[Formula 24]}$$

The present invention can be suitably applied to either case described above.

Figure 8:
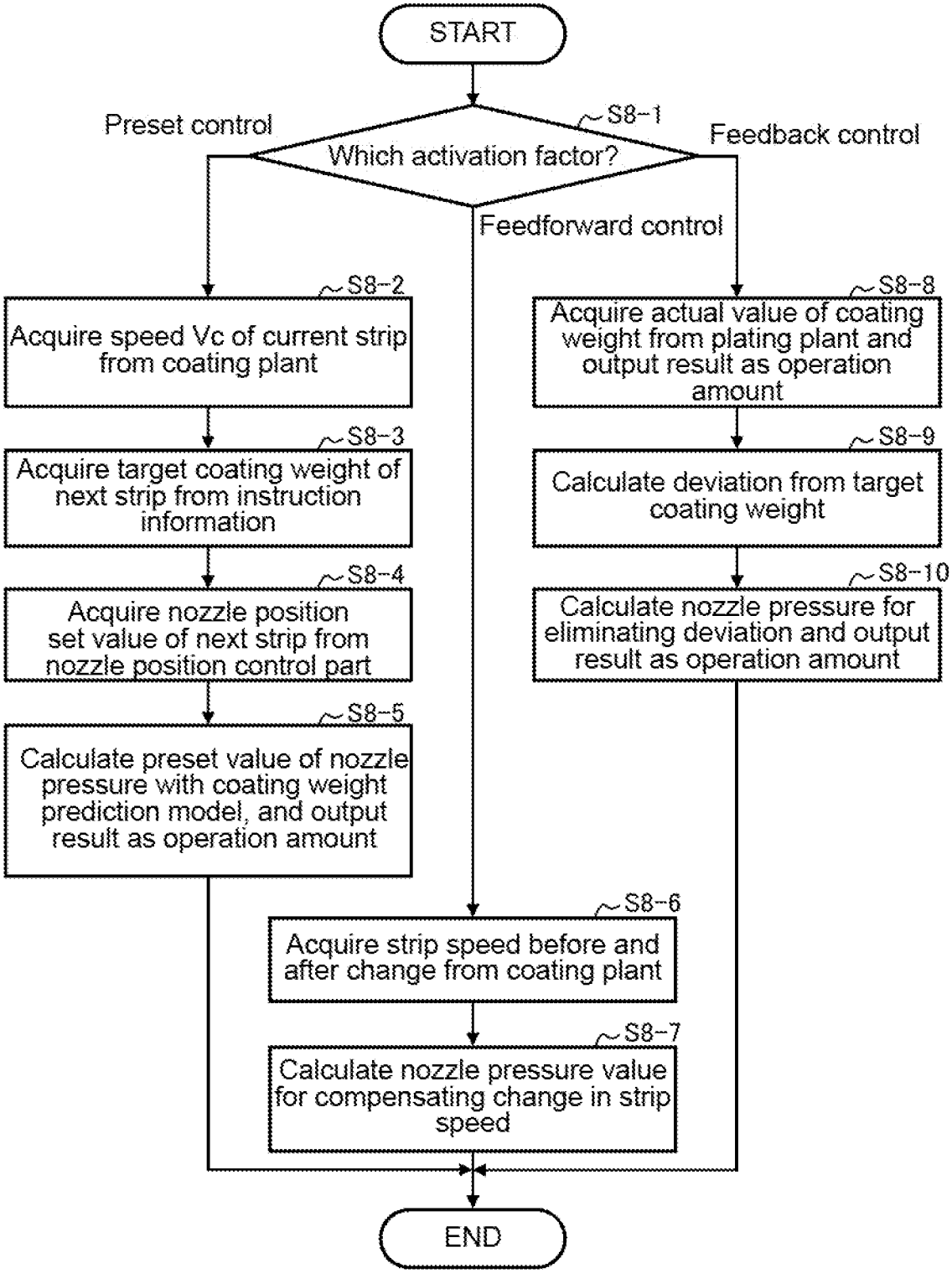
FIG. 8 is a flowchart illustrating a processing performed by a nozzle pressure control part according to the first embodiment.

FIG. 8 is a flowchart illustrating a processing performed by the nozzle pressure control part 102 of the controller 101. The nozzle pressure control part 102 provides three types of controls, namely, preset control, feedforward control, and feedback control. Under the preset control, a pressure of the nozzle 153 onto the strip 151 to be treated next is calculated such that the pressure realizes a target coating weight in accordance with the instruction information 201. Under the feedforward control, change in a state of the strip 151 such as a strip speed change is acquired, and an adjustment amount of the nozzle pressure for compensating influence of the change on a coating weight is calculated. Under the feedback control, when there is a deviation between the target coating weight and an actual coating weight detected by the coating weight detector 155, an adjustment amount of a nozzle pressure for reducing the deviation is calculated. In S8-1, which activation factor has occurred and which control is to be provided is determined from among the preset control, the feedforward control, and the feedback control. The activation factor can be determined based on the actual value information acquired from the coating plant 150. For example, what is determined as the activation factor is: in the preset control, that the welding point 156 has passed through a position of the nozzle 153; in the feedforward control, that a speed of the strip 151 has changed; and, in the feedback control, that a new coating weight is detected by the coating weight detector 155. When the preset control is activated, in S8-2, a speed Vc of the currently-being-treated strip 151 is acquired from the coating plant 150. In S8-3, a target coating weight of the strip 151 to be treated next is acquired from the instruction information 201. In S8-4, a nozzle position set value of the strip 151 to be treated next is acquired from the nozzle position control part 103. In place of the nozzle position set value of the next strip 151, a nozzle gap of the next strip 151 acquired from the instruction information may be used. In S8-5, a preset value of the nozzle pressure is calculated using the acquired value and referencing a coating weight prediction model in accordance with Formula 25; and the calculated value is outputted as an operation value of the nozzle 153.

$$Pn=f-1(Wn,Dn,Vc) \quad \text{[Formula 25]}$$

wherein Wn: target coating weight of strip to be treated next, acquired from instruction information, Dn: nozzle gap of strip to be treated next, acquired from instruction information, and f−1: right side of result when Formula 1 is solved with respect to nozzle pressure P.

When the feedforward control is activated, in S8-6, a strip speed before and after the change is acquired from the coating plant 150. In S8-7, a nozzle pressure adjustment amount for compensating the speed change is calculated in accordance with Formula 26; and a current nozzle pressure is thereby corrected. An influence coefficient used in Formula 26 is a ratio between a nozzle pressure and a speed required for increasing or decreasing a coating weight by unit amount.

$$Pn=Pc+\gamma 1\times(\partial P/\partial V)\times(Vn-Vc) \quad \text{[Formula 26]}$$

wherein Pc: current nozzle pressure, Pn: nozzle pressure operation value, Vc: speed before change, Vn: speed after change, γ1: control gain, and (∂P/∂V): influence coefficient.

When the activation factor is the feedback control, in S8-8, an actual coating weight is acquired from the coating weight detector 155. In S8-9, a deviation is calculated from a target coating weight Wn acquired from the instruction information 201. In S8-10, a nozzle pressure which can eliminate the deviation is calculated, and the calculated result is outputted to the nozzle 153 as an operation value. More specifically, the current nozzle pressure is corrected with reference to Formula 27. An influence coefficient in Formula 27 is an amount of change in nozzle pressure required for increasing or decreasing a coating weight by unit amount.

$$Pn=Pc+\gamma 2\times(\partial P\partial W)\times(Wn-Wc) \quad \text{[Formula 27]}$$

wherein Wc=(TR+TC+TL+BR+BC+BL)/6, Wn: target coating weight, and (∂P/∂W): influence coefficient, and γ2: control gain.

As described above, the controller 101 includes the nozzle pressure control part 102 and the nozzle position control part 103. The controller 101 can thereby control a coating weight coated to the strip 151, to a target value and can also control a position of the nozzle 153 in accordance with a passing position movement of the strip 151. This makes it possible to prevent the nozzle 153 and the strip 151 from coming into contact with each other and also to maintain a balance of coating weights on the front and back sides of the strip 151.

In this embodiment, description has been made assuming an example in which a change in speed of the strip 151 is the activation factor for the feedforward control by the nozzle pressure control part 102. Another possible activation factor is that, for example, a distance between the strip 151 and the nozzle 153 has changed caused by, for example, manual correction of a target coating weight by an operator, or a change in thickness of the strip 151. Also in that case, the feedforward control can be performed using a similar technique. In this embodiment, description has been made assuming an example in which a nozzle pressure is used in controlling a sum of coating weights on the both sides in the feedback control. Alternatively, a change in position of the nozzle 153 (opening and closing of the nozzle 153) can be used without changing the pressure. Even in that case, the processing performed by the strip passing position movement amount estimate part 105 described in this embodiment can be applied as it is.

Second Embodiment

Figure 9:
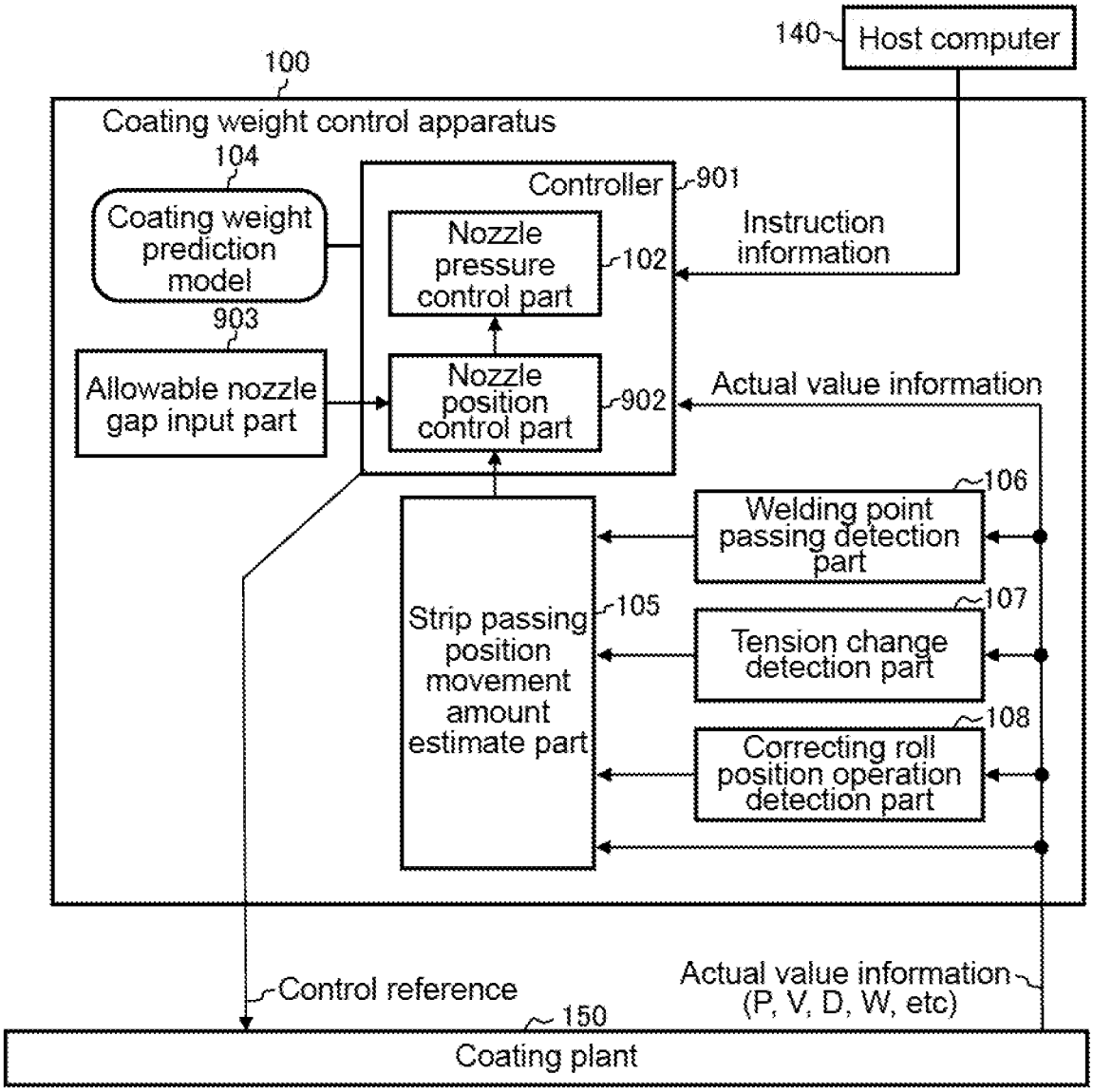
FIG. 9 is a block diagram illustrating a configuration in which an allowable nozzle gap input part is added to a configuration of FIG. 12, according to a second embodiment of the present invention.

FIG. 9 is a block diagram illustrating a configuration of a coating weight control apparatus 100 according to a second embodiment of the present invention. The coating weight control apparatus 100 includes an allowable nozzle gap input part 903 that allows a user to input an allowable nozzle gap which is a minimum allowable distance between the nozzle 153 and the strip 151. The allowable nozzle gap used herein takes such a value that the strip 151 and the nozzle 153 do not come in contact with each other, taking into account a thickness of the strip 151, and a shape, a warp, and an amplitude of fluttering of an end of the strip 151, or the like. Generally, the strip 151 is not well-shaped at and around the welding point 156. The allowable nozzle gap can be thus set to a value a little on a large side before passing of the welding point 156 and can be then restored to its original value after passing of the welding point 156. Or, the allowable nozzle gap may be determined so as to be used as an operating point of an operation in which coating is conducted at a prescribed nozzle pressure or higher. The allowable nozzle gap input part 903 is realized by, for example, a HMI (Human Machine Interface) screen equipped with the coating weight control apparatus 100. The allowable nozzle gap input part 903 allows a user to input a desired allowable nozzle gap by, for example, changing a value of the allowable nozzle gap on the screen. The inputted allowable nozzle gap is transmitted to the nozzle position control part 902. The nozzle position control part 902 then provides control on a position of the nozzle based on the inputted nozzle gap.

Figure 10:
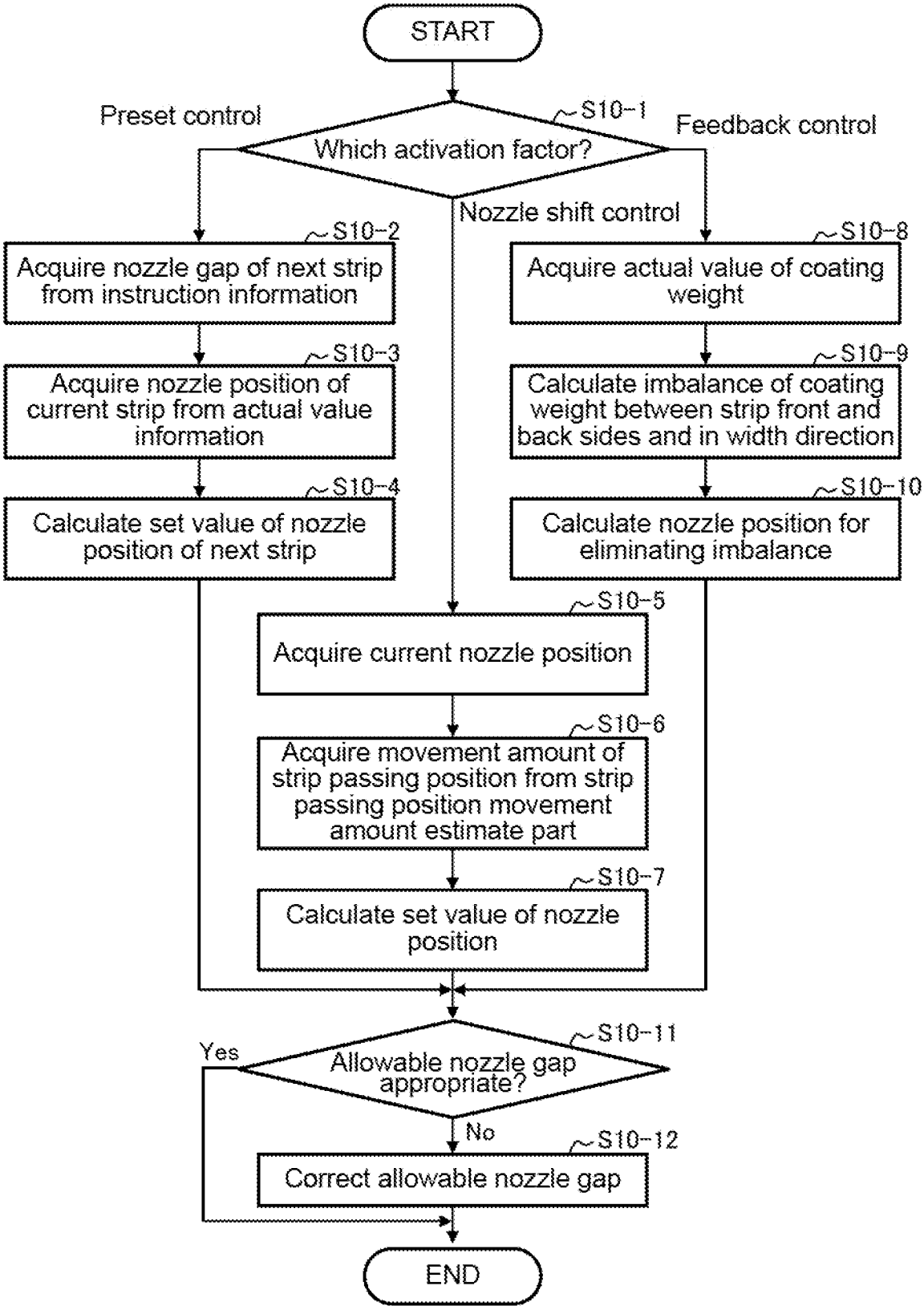
FIG. 10 is a flowchart illustrating a processing performed by a nozzle position control part using the allowable nozzle gap according to the second embodiment.

FIG. 10 is a flowchart illustrating a processing performed by the nozzle position control part 902. S10-1 to S10-10 in FIG. 10 are similar to S7-1 to S7-10 in FIG. 7, description of which is thus omitted herein. After the steps on the preset, movement of a strip passing position, and feedback according to the activation factor are completed, in S10-11, it is determined whether or not an allowable nozzle gap is appropriate to satisfy a prescribed condition. The determination is made to Dn1, Dn2, Dn3, Dn4, and an allowable nozzle gap Dlim in Formula 17 to Formula 20 and Formula 21 to Formula 24, in accordance with Formula 28.

$$D\lim\Delta\leq D\min$$

wherein Dmin=Min(Dm1, Dm2, Dm3, Dm4)

$$Dm1=Dn1-Dp$$

$$Dm2=Dn2-Dp$$

$$Dm3=Dn3-Dp$$

$$Dm4=Dn4-Dp$$

$$Dp=(Dn1+Dn2-Dn3-Dn4)/4$$

Figure 11:
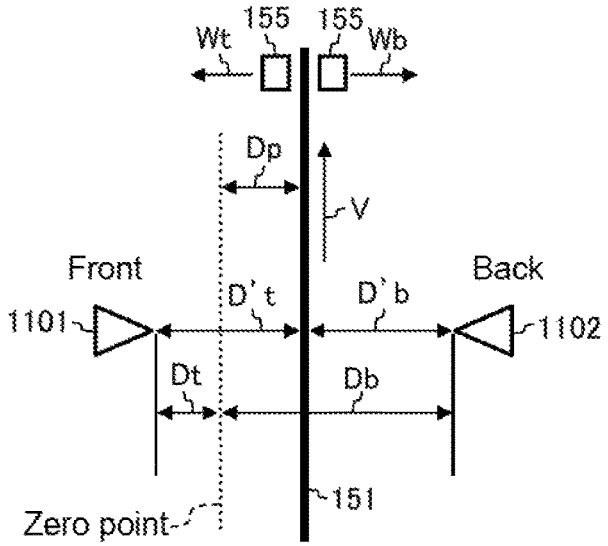
FIG. 11 is an explanatory diagram illustrating how to estimate a movement amount of a strip passing position according to the second embodiment.

FIG. 11 is a schematic diagram for explaining a center position of the nozzle 153 in Formula 28. FIG. 11 is a simplified diagram assuming that positions of the front and back sides nozzles of the nozzle 153 illustrated in FIG. 1 are the same with respect to the strip width direction, and shows a relationship between a nozzle position and a strip passing position. Each of a position Dt of a front side nozzle 1101 and a position Db of a back side nozzle 1102 represents a displacement with respect to a zero point. In the figure, a distance between the strip 151 and the front side nozzle 1101 is D't. A distance between the strip 151 and the back side nozzle 1102 is D'b. In Formula 28, (Dn1+Dn2−Dn3−Dn4)/4 corresponds to Dp in FIG. 11. (Dn1+Dn2−Dn3−Dn4)/4 is subtracted from each of the nozzle positions Dn1 to Dn4, which corresponds to a distance between the strip 151 and each of the nozzle positions. Dmin is the smallest value of Dm1, Dm2, Dm3, and Dm4. Thus, if Dmin is equal to or larger than Dlim, the allowable nozzle gap is determined to be appropriate, and the processing terminates. If Dmin is smaller than Dlim, in S10-12, the allowable nozzle gap is corrected. More specifically, each of the nozzle positions are corrected such that Dmin becomes equal to or larger than Dlim, using Formula 29 to Formula 32, to thereby calculate new Dn1 to Dn4.

$$Dn1=Dn1+(Dlim-Dmin) \quad \text{[Formula 29]}$$

$$Dn2=Dn2+(Dlim-Dmin) \quad \text{[Formula 30]}$$

$$Dn3=Dn3+(Dlim-Dmin) \quad \text{[Formula 31]}$$

$$Dn4=Dn4+(Dlim-Dmin) \quad \text{[Formula 32]}$$

Addition of (Dlim−Dmin) to each of the nozzle positions results in Dlim as the smallest value of Dn1 to Dn4, which means that each of all the nozzle positions takes a value equal to or larger than the allowable nozzle gap. In this embodiment, even a nozzle position closest to the strip 151 can take a value equal to or larger than an allowable nozzle gap thereof. This makes it possible to reduce a risk that the nozzle 153 and the strip 151 come in contact with each other. Also, when an operation is performed in such a manner that a distance between the nozzle 153 and the strip 151 maintains a prescribed value, the operation can be easily realized by setting Dlim at the distance as an operating point.

The present invention can be widely applied to controlling on coating weights of coating in a steel processing line.

DESCRIPTION OF REFERENCE NUMERALS

100 coating weight control apparatus
101 controller
102 nozzle pressure control part
103 nozzle position control part
104 coating weight prediction model
105 strip passing position movement amount estimate part
106 welding point passing detection part
107 tension change detection part
108 correcting roll position operation detection part
140 host computer
150 coating plant
151 strip
153 nozzle
155 coating weight detector
156 welding point
901 controller
902 nozzle position control part
903 allowable nozzle gap input part

The invention claimed is:

1. A coating weight control apparatus that provides control on a coating plant in which a series of continuously-fed strips in which two adjacent strips are welded at a welding point: are immersed in a pot of a hot-dip coating bath so as to coat the strips with the hot-dip coating bath; are removed therefrom; are sprayed with gas from each of a front side nozzle and a back side nozzle facing a front side and a back side of the strips, respectively; and are subjected to removal of excessive hot-dip coating bath, to thereby coat the strips with the hot-dip coating bath in a desired thickness, the coating weight control apparatus comprising:

a coating weight prediction model in which relationships among a speed of the strips, respective pressures of the front side nozzle and the back side nozzle, respective distances between each of the front side nozzle and the back side nozzle and the strips, and a coating weight which is an amount of the hot-dip coating bath coated on the strips are described;

a controller configured to control at least one of the pressures of the front side nozzle and the back side nozzle and respective positions of the front side nozzle and the back side nozzle such that, by referencing the coating weight prediction model, the coating weight of the hot-dip coating bath coated on the strips takes a desired value; and a strip passing position movement amount estimate part configured to estimate a movement amount of a strip passing position, the strip passing position being a position at which the strips pass through with respect to a height of the any one of the front side nozzle and the back side nozzle, when at least one of the following changes, (1) thicknesses between two adjacent strips across a welding point, (2) tensions of the strips, and (3) a position of a correcting roll that supports the strips in the pot, and to then output the estimated movement amount to the controller;

a welding point passing detection part configured to detect whether or not the welding point passes through a prescribed position of the coating plant;

a tension change detection part configured to detect whether or not there is a change in the tensions of the strips; and a correcting roll position operation detection part configured to detect whether or not the correcting roll position has been operated, wherein the strip passing position movement amount estimate part is configured to be activated in accordance with the result detected by any of the welding point passing detection part, the tension change detection part, and the correcting roll position operation detection part, and the estimate a movement amount of a strip passing position.

2. The coating weight control apparatus according to claim 1, wherein the strip passing position movement amount estimate part is configured to estimate the movement amount of the strip passing position by a computing using at least one of thicknesses of two welded adjacent strips, strengths thereof, tensions thereof, and a position of the correcting roll, wherein the strip passing position movement amount estimate part is configured to estimate the movement amount of the strip passing position by a computing using any of amounts of a tension change of the strips, thicknesses thereof, strengths thereof, and a position of the correcting roll, and wherein the strip passing position movement amount estimate part is configured to estimate the movement amount of the strip passing position by a computing using any of thicknesses of the strips, strengths thereof, tensions thereof, a position of the correcting roll before being operated, and a position thereof after being operated.

3. The coating weight control apparatus according to claim 1, wherein the controller includes a nozzle position control part configured to control respective positions of the front side nozzle and the back side nozzle, and wherein the nozzle position control part is configured to shift each of the positions of the front side nozzle and the back side nozzle in a direction in which the strip passing position changes, by a value corresponding to the movement amount of the strip passing position outputted by the strip passing position movement amount estimate part.

4. The coating weight control apparatus according to claim 1, wherein the controller includes a nozzle position control part configured to control respective positions of the front side nozzle and the back side nozzle, and wherein the nozzle position control part is configured to shift each of the positions of the front side nozzle and the back side nozzle in a direction in which the strip passing position changes, by a value corresponding to the movement amount of the strip passing position outputted by the strip passing position movement amount estimate part.

5. The coating weight control apparatus according to claim 2, wherein the controller includes a nozzle position control part configured to control respective positions of the front side nozzle and the back side nozzle, and wherein the nozzle position control part is configured to shift each of the positions of the front side nozzle and the back side nozzle in a direction in which the strip passing position changes, by a value corresponding to the movement amount of the strip passing position outputted by the strip passing position movement amount estimate part.

6. The coating weight control apparatus according to claim 3, further comprising an allowable nozzle gap input part configured to allow input of minimum allowable distances between each of the front side nozzle and the back side nozzle and the strips, and wherein the nozzle position control part is configured to: calculate instructions for the control of the nozzle positions; determine a point situated in each of the front side nozzle and the back side nozzle, the point being the closest to the strips, when the nozzle position control instructions are calculated; and compute a distance between each of the points and the strips as a first distance, wherein, if the first distance is smaller than the minimum distance inputted from the allowable nozzle gap input part, the nozzle position control part is configured to: add a second distance to the nozzle position control instructions, the second distance being obtained by subtracting the first distance from the minimum distance; and output the resultant instructions, and wherein, if the first distance is not smaller than the minimum distance inputted from the allowable nozzle gap input part, the nozzle position control instructions are outputted as they are.

7. The coating weight control apparatus according to claim 4, further comprising an allowable nozzle gap input part configured to allow input of minimum allowable distances between each of the front side nozzle and the back side nozzle and the strips, and wherein the nozzle position control part is configured to: calculate instructions for the control of the nozzle positions; determine a point situated in each of the front side nozzle and the back side nozzle, the point being the closest to the strips, when the nozzle position control instructions are calculated; and compute a distance between each of the points and the strips as a first distance, wherein, if the first distance is smaller than the minimum distance inputted from the allowable nozzle gap input part, the nozzle position control part is configured to: add a second distance to the nozzle position control instructions, the second distance being obtained by subtracting the first distance from the minimum distance; and output the resultant instructions, and wherein, if the first distance is not smaller than the minimum distance inputted from the allowable nozzle gap input part, the nozzle position control instructions are outputted as they are.

8. The coating weight control apparatus according to claim 5, further comprising an allowable nozzle gap input part configured to allow input of minimum allowable distances between each of the front side nozzle and the back side nozzle and the strips, and wherein the nozzle position control part is configured to: calculate instructions for the control of the nozzle positions; determine a point situated in each of the front side nozzle and the back side nozzle, the point being the closest to the strips, when the nozzle position control instructions are calculated; and compute a distance between each of the points and the strips as a first distance, wherein, if the first distance is smaller than the minimum distance inputted from the allowable nozzle gap input part, the nozzle position control part is configured to: add a second distance to the nozzle position control instructions, the second distance being obtained by subtracting the first distance from the minimum distance; and output the resultant instructions, and wherein, if the first distance is not smaller than the minimum distance inputted from the allowable nozzle gap input part, the nozzle position control instructions are outputted as they are.

* * * * *